US006309308B1

(12) United States Patent
Bennett

(10) Patent No.: US 6,309,308 B1
(45) Date of Patent: Oct. 30, 2001

(54) GOLF CLUB HOLDER

(76) Inventor: Robert A. Bennett, 120 Sheffield Cir., Stratford, CT (US) 06614

( * ) Notice: Subject to any disclaimer, the term of this patent is extended or adjusted under 35 U.S.C. 154(b) by 0 days.

(21) Appl. No.: 09/515,154

(22) Filed: Feb. 29, 2000

(51) Int. Cl.[7] ..... A63B 55/10

(52) U.S. Cl. ..... 473/282; 248/156; 248/688

(58) Field of Search ..... 473/282; 211/70.2, 211/70.8; 248/688, 689, 530, 519, 156

(56) References Cited

U.S. PATENT DOCUMENTS 5,417,334 * 5/1995 Wu .
5,437,449 * 8/1995 Zink .
5,730,404 * 3/1998 Evans .
5,782,443 * 7/1998 La Fontaine .

* cited by examiner

*Primary Examiner*—Jeanette Chapman
*Assistant Examiner*—Stephen L. Blau

(57) ABSTRACT

A holder for a golf club employing two joined but relatively adjustable members for detachably receiving and holding the club and a vertical spike suspended between the members.

3 Claims, 1 Drawing Sheet

FIG. 1
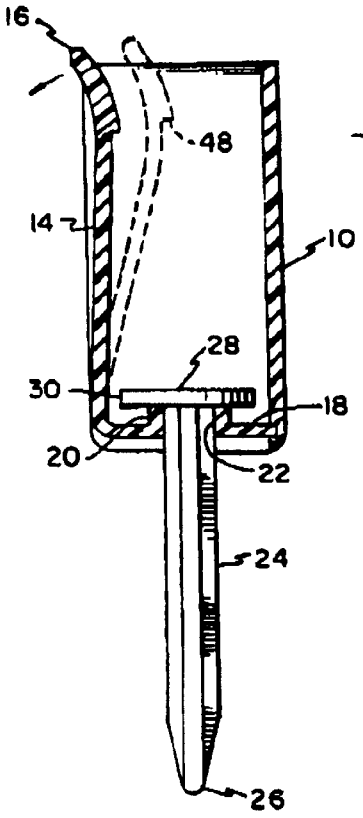
FIG. 2
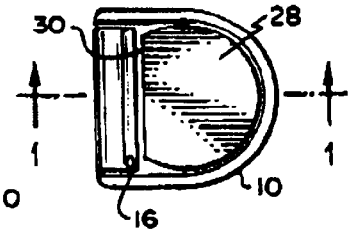
FIG. 3
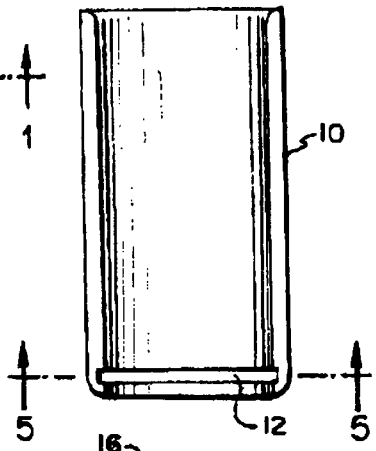
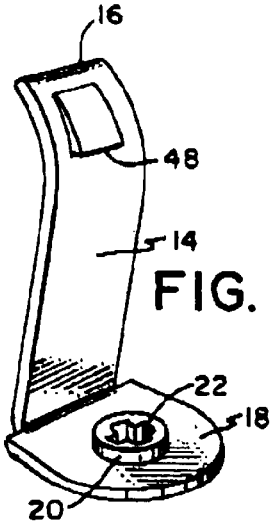
FIG. 4
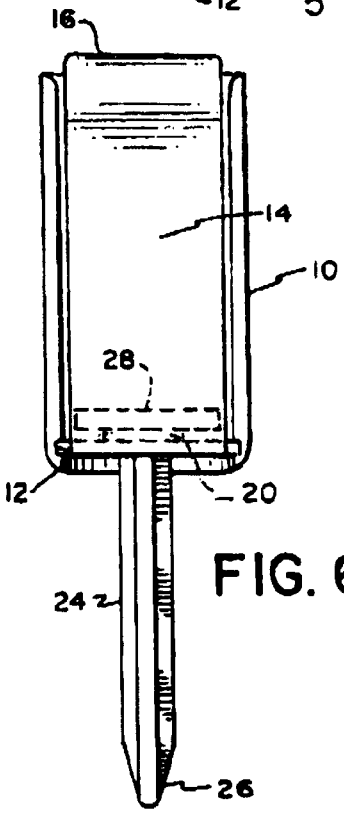
FIG. 6
FIG. 5
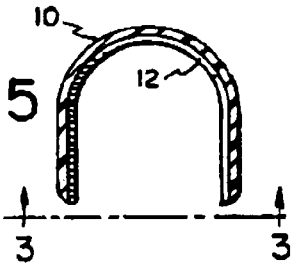
FIG. 8
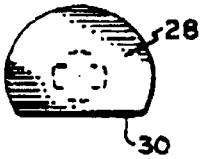
FIG. 7
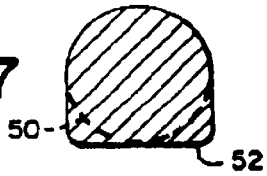

GOLF CLUB HOLDER

BACKGROUND OF THE INVENTION

A golfer driving a golf ball onto or adjacent a green of a hole often carries two clubs, one club being an iron to be used in making an approach shot, the other club being a putter for attempting to sink the ball into the hole cup. When the golfer is using one club, the other club is often placed on the ground. As a result, the handle of the other club often becomes wet and difficult to use. Moreover, the golfer may forget and leave the unused club on the ground.

The present invention is directed toward a holder for a golf club which will enable a golfer to temporarily place the holder in the ground and place the handle of an unused club in the holder with the club being disposed upside down and extending upward from the holder. In this manner, the handle does not get wet and moreover, the club is so disposed that the golfer will remember to take the club by first removing the club and the holder from the ground and then removing the holder from the club. The golfer can then carry the holder for subsequent use.

The holder can be attached to a golf bag by a snap clip.

SUMMARY OF THE INVENTION

In accordance with the principles of this invention, a holder for receiving and detachably supporting the handle of a golf club employs a first member in the shape of a vertical hollow elongated member having in horizontal cross section the shape of a U. The upper end of the member has a U shaped opening large enough to receive with small clearance a golf club handle. The handle can have a circular cross section, or a partial circular cross section with a flat portion or other similar shape. The lower end of the member defines a somewhat larger open concentric U shape.

A second vertically elongated flexible member has a vertically elongated main body with an upper end which curves outward and a lower end which terminates in a flat horizontal extension. The flat extension is held in a flat horizontal groove in the first member slightly above the lower end and closes off this lower end. The flat extension has a flat cylinder secured to its upper surface. The cylinder has an opening typically of cruciform shape.

A vertical spike having in horizontal cross section the same shape as the opening but slightly smaller extends slidably downwardly through the opening. The lower end of the spike is pointed. The upper end of the spike is an enlarged flat disc having a U shape with a flat edge.

In use the holder is positioned vertically. The inverted handle of a club is pushed into the open end of the first member and pushes the disc downward until it engages the cylinder. This action forces the spike to its maximum extension outside of the cylinder. The club is then moved downward to force the spike into the ground, thus suspending the club in vertically inverted position in the holder which is held in position by the spike.

Consequently when the holder is pulled out of the ground and the club handle is removed, the spike can be returned to its original position and will be automatically cleaned from dirt as it is pulled upward through the opening.

Since the club handle may in cross section have a circular or oblong or other shape, it may be necessary to bend or flex the upper end of the second member outwardly from the first member in order to hold the club handle in position. This action enables the club handle to be properly positioned in the second member. As soon as the second member is released, it returns to its original position and locks the handle in position. The upper end of the second member can have a small stop or the like secured to its inner surface to prevent the spike from separating from the two members. The invention can then be used as previously described.

Additional objects and advantages of the invention will be described in more detail hereinafter.

BRIEF DESCRIPTION OF THE DRAWINGS

FIG. 1 is a vertical cross sectional view of the holder taken along line 1—1 in FIG. 2.

FIG. 2 is a top view of the holder.

FIG. 3 is an end view of the first member of the holder taken along 3—3 in FIG. 5.

FIG. 4 is a perspective view of the second member of the holder.

FIG. 5 is a cross sectional view taken along line 5—5 in FIG. 3.

FIG. 6 is a cross sectional view of the holder as rotated through ninety degrees with respect to the end view of FIG. 1.

FIG. 7 shows in horizontal cross section two different club handles

FIG. 8 is a top view of the spike employed in the holder.

DETAILED DESCRIPTION OF PREFERRED EMBODIMENT

Referring now to FIGS. 1–8, in accordance with the principles of this invention, a holder for receiving and detachably supporting the handle of a golf club employs a first member 10 in the shape of a vertical hollow elongated member having in horizontal cross section the shape of a U.

The upper end of the member has an open U shape large enough to receive with small clearance a golf club handle. This handle in cross section can have a circular cross section 50, or a partial circular cross section 52 with a flat portion or other similar shape. The lower end of the cylinder defines a somewhat larger open concentric U shape and supports a horizontal groove 12 disposed slightly above the lower open end.

A second vertically elongated flexible member has a main vertically elongated body 14 with an upper end 16 which curves outward and a lower end which terminates in a flat horizontal extension 18 locked in position by engaging the groove 12.

The main body 14 has a small wedge 48 secured to its inner surface adjacent its upper end. The extension 18 has a flat cylinder 20 integral with its upper surface. The cylinder has an opening 22 typically of cruciform shape.

A vertical spike 24 having in horizontal cross section the same shape as the opening but slightly smaller extends slidably downwardly through the opening. The lower end of the spike is pointed at 26. The upper end of the spike is an enlarged flat disc 28 vertically slidable in the first member. The disc has a U shape and a flat edge 30 which bears against body 14 to prevent the spike from undesired rotational movement. The stop 48 prevents the spike from vertically separating from the first member.

In use the holder is positioned vertically. The handle of a club with the club inverted is pushed into the open end of the first member and pushes the disc 28 downward until it engages the cylinder 20. This action forces the spike 24 to its maximum extension outside of the cylinder. The club is then moved downward to force the spike into the ground, thus suspending the club in vertically inverted position in the holder which is held in position by the spike.

Since the club handle may in cross section have a circular or oblong or other shape, the upper end 16 of the second member acts as a spring bearing against an inserted club handle regardless of the shape of the handle. If necessary, the user can apply thumb pressure to cause this upper end to pivot outwardly and enable the club handle to be properly positioned. The end 16 can then be released and automatically returns to its original position, locking the handle in position.

The first member has a slight outward and downwardly extending curvature. This enables the golf handle to be easily fitted into position and at the same time permits easy release of the handle when necessary.

While the invention has been described with particular reference to the detailed description and the drawings, the protection sought is to be limited only by the terms of the claims which follow

What is claimed is:

1. A holder for detachably receiving and supporting a handle of a golf club regardless of the cross sectional shape of the handle, said holder comprising:

an elongated vertical hollow first member having in horizontal cross section the shape of a U, the first member having an open upper end large enough to receive with small clearance the golf handle, the first member having a lower open end of somewhat larger concentric shape and being provided with a horizontal groove disposed somewhat above the lower end of the first member;

a second vertically elongated flexible member having a vertically elongated main body with an upper end that curves outward and a lower end which terminates in a flat horizontal extension which engages the groove and is thus secured to and closes off the lower end of the first member, said main body having a spring function for detachably locking said handle in inverted position in said first member, the extension having a flat cylinder secured to its upper surface, the cylinder having an opening of selected cross sectional shape; and a vertical spike having in horizontal cross section of the same shape of said opening but of slightly smaller size, said spike extending downwardly through said opening, a lower end of the spike being pointed, an upper end of the spike terminating in a flat horizontal disc having a diameter larger than that of said cylinder.

2. The holder of claim 1 wherein the upper end of the main body has a wedge which prevents the spike from being detached from the first member.

3. The holder of claim 2 wherein an inner surface of the first member prevents rotation of said spike.

* * * * *